United States Patent [19]

Brady

[11] 4,178,851

[45] Dec. 18, 1979

[54] DUAL PURPOSE MUNITION

[75] Inventor: Joseph F. Brady, Bethlehem, Pa.

[73] Assignee: The United States of America as represented by the Secretary of the Army, Washington, D.C.

[21] Appl. No.: 233,831

[22] Filed: Mar. 8, 1972

[51] Int. Cl.[2] ..... F42B 25/02; F42B 25/16

[52] U.S. Cl. ..... 102/4; 102/7.2; 102/24 HC

[58] Field of Search ..... 102/24 HC, 70, 7.2, 102/6, 4

[56] References Cited

U.S. PATENT DOCUMENTS

| | | | |
|---|---|---|---|
| 3,093,072 | 6/1963 | Pigman | 102/7.2 |
| 3,170,398 | 2/1965 | Paulson et al. | 102/6 |
| 3,344,742 | 10/1967 | Schneider, Jr. | 102/8 |

*Primary Examiner*—David H. Brown

*Attorney, Agent, or Firm*—Nathan Edelberg; Harold H. Card, Jr.; A. Victor Erkkila

[57] ABSTRACT

An air delivered armor piercing and anti-personnel munition which includes a pair of spin latched overlay hemispherical shells whose outer surface is fluted and which encase the fragmentation grenade munition. One of the shells is affixed to the munition by a lanyard so that when the munition is released it will be caused to spin by the fluted surface which in turn will result in unlatching of the shells and release of one while the other (drag hemisphere) acts to limit the descent velocity and maintains the munition in an upright position. The grenade is provided with spring loaded standoff legs which are retracted when the grenade is within the shell but assume their extended downward position upon release of the outer shells. The shell separation also initiates the arming of the grenade fuze. The interial force generated by the impact impales the grenade firing pin in the detonator thus commencing the detonation train. The grenade includes an outer fragmentation housing which is fragmented by detonation of the internally shaped high explosive charge.

7 Claims, 7 Drawing Figures

DUAL PURPOSE MUNITION

The invention described herein may be manufactured, used and licensed by or for the Government for governmental purposes without the payment to me of any royalty thereon.

BACKGROUND OF THE INVENTION

The present invention relates to a multi-purpose munition and more particularly pertains to an air dropped dispersion type armor piercing and anti-personnel submissile grenade having a dual capability and launchable from a missile warhead.

In the field of submissiling munitions, it has been the general practice to employ specific submissiles against particular targets. In general such devices have not been entirely satisfactory in that the submissiles were only effective against the particular target for which they were originally designed. Namely, anti-personnel weapons are ineffective against armored targets while armor defeating munitions are inefficient when directed toward personnel. The present invention overcomes this problem and fills the needed weapon system void.

SUMMARY OF THE INVENTION

The general purpose of this invention is to provide a dual capability type submissile that has all the advantages of similarly employed prior art devices and has none of the above described disadvantages. To attain this, the present invention provides a unique submissile arrangement which includes a fragmentation grenade having therein a shaped charge and carrying a plurality of depending standoff legs which are spring loaded to extend when released. The grenade is carried within a centrifugally, latched together, pair of shell-like overlay hemispheres and is tied to one of these hemispheres by a lanyard. The standoff legs are retracted between the overlay hemispheres and the grenade so that when the munition is air dropped the fluted outer surface of the formed sphere will induce spin that in turn will unlatch the hemispheres. The grenade also includes an arming fuze system and an impact detonator apparatus to provide a detonation train for the shaped high explosive carried therein.

An object of the present invention is to provide a simple, reliable, inexpensive, dual purpose, air dropped munition.

Another object is the provision of a spin armed dual purpose submunition whose descent is controlled, and whose dispersion when released from a warhead provides effective coverage against armor and personnel.

Still another object is to provide an armor piercing anti-personnel grenade munition capable of being air dropped in substantial quantities.

Other objects and many of the attendant advantages of this invention will be readily appreciated as the same becomes better understood by reference to the following detailed description when considered in connection with the accompanying drawings wherein.

BRIEF DESCRIPTION OF A PREFERRED EMBODIMENT

Figure 1A:
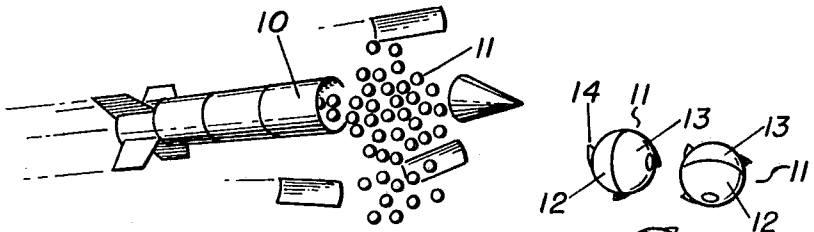
FIGS. 1(*a–e*) illustrate the operational sequence of the munition from launch to impact.
Figure 1B:
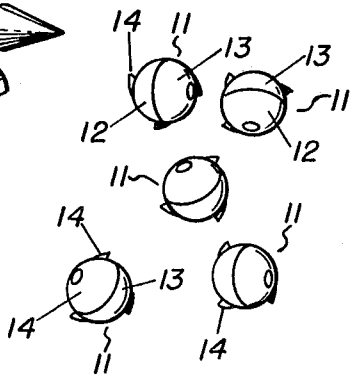
Figure 1C:
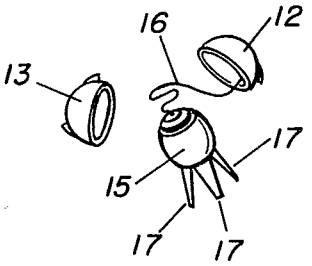
Figure 1D:
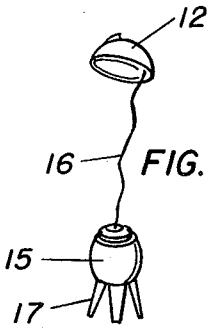
Figure 1E:
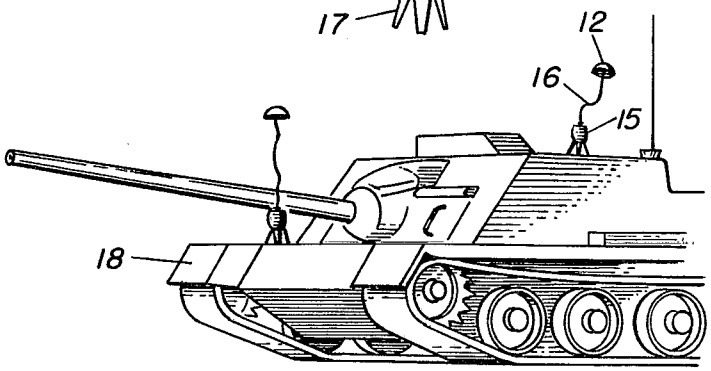
Figure 3:
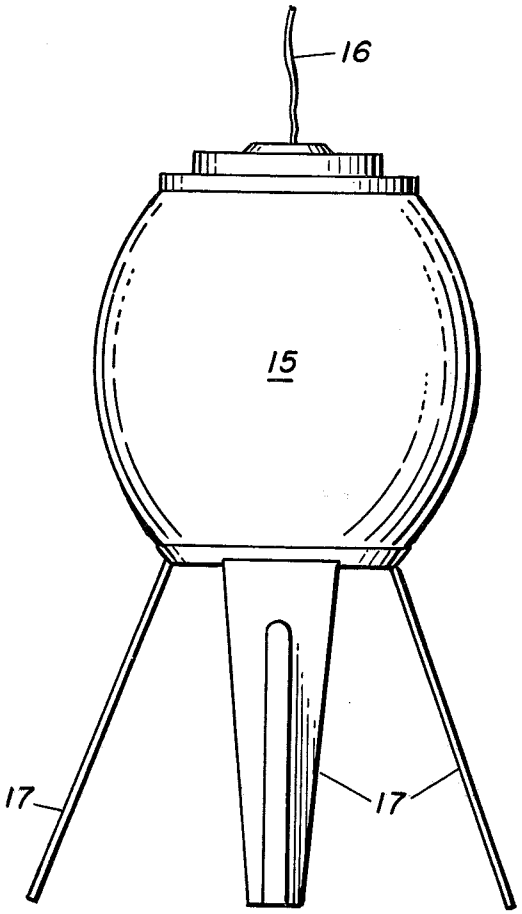

In the illustrated embodiment of FIG. 1 the missile 10 which carries a plurality of submissiles or submunitions 11 discharges these submissiles at some selected point along its trajectory path which then begin their descent. Each submissile is provided on its outer shell, which in this instance is composed of a pair of overlay hollow hemispheres 12 and 13, with a plurality of flutes 14. This fluted surface imparts to the submunition a spin momentum that induces or imparts to the multitude of discharged submissiles the proper degree of relative dispersion, resulting in a scattered pattern of hits. As the munition continues to increase its linear and spin velocities, the latter attains a sufficient value to release the internal centrifugal latch which holds the hemispheres in abutment. The hemispheres separate but one, 12, is secured to the explosive munition as for example a grenade 15, by a lanyard 16. The release of the hemispheres additionally allows the spring load standoff legs 17 to assume and lock in their proper orientation and arms the fuze carried by the grenade. Continuing its rapid descent the munition is both righted with the legs directed earthward and its linear velocity limited by the attached drag hemisphere 12 while the spin velocity is almost entirely eliminated. Upon impact either with a target, such as an armored vehicle 18, or the ground, the detonator of the munition initiates the detonation train that thereupon results in the explosion of the grenade in its upright position.

Figure 2:
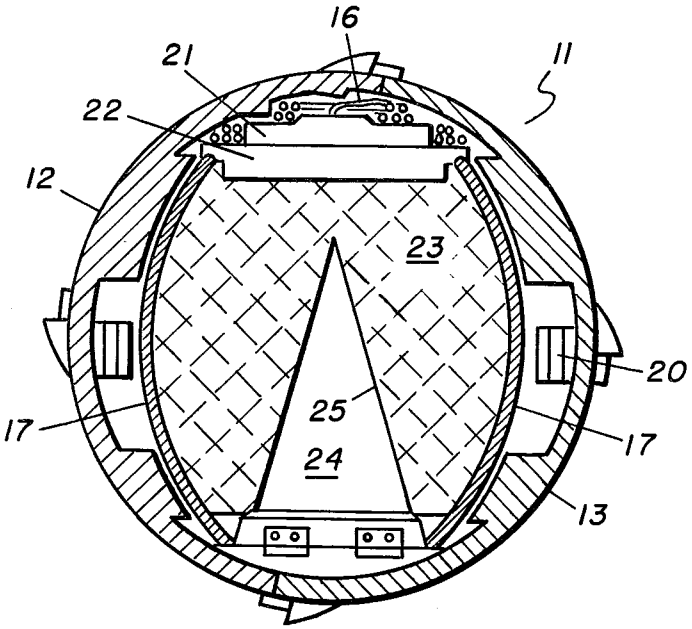
FIG. 2 is a cross-sectional view of an embodiment made in accordance with the principle of this invention in the unarmed state; and, FIG. 3 is the embodiment of FIG. 2 in the armed condition.

Referring now to FIG. 2 wherein the munition 11 is shown in its unarmed state, namely, prior to being air dropped. The outer or overlay hemispheres 12 and 13 are releasably held together by a centrifugally actuated latch 20 which may be identical or similar to the T-58 presently available for this intended purpose. The inner faces of the hemispheres are formed so as to receive and secure therebetween the fragmentation grenade 15, the initial fuze 21 and its associated booster 22 as well as the spring-load standoff legs 17 that are in a restrained position intermediate the grenade and the hemispheres. The legs are biased when unrestrained, to extend downwardly. The inner spherical face supports the grenade in a position such that the center of gravity and rotation of the overall submissile is located at the geometrical, structural center thereof. The shell of the grenade is structurally arranged to provide lethal fragmentation as by embossing the surface thereof or any other suitable means presently available such as steel balls imbedded in an aluminum matrix. The interior of the fragmentation grenade is filled with a shaped high explosive charge 23 which may be Octol with the center thereof deleted to provide a central aperture in the form of a cone 24 with its apex directed upwardly and provided with a liner 25. Thus upon detonation of the high explosive, a jet particle stream will be generated and propelled downwardly intermediate the legs 17 as well as fragment dispersion of the embossed shell of the grenade.

Summarizing the operation, a quantity of submissile munitions are delivered by a missile to a predetermined point along its trajectory path with respect to an intended target. As the warhead transits this point it releases a large quantity of spherical submissile bomblets. Each submissile falls a short distance prior to the commencement of self-induced rotation. The overlay composed of two hemispheres, each provided with aerodynamic flutes on its external surface, causes the auto-rotation. The two hemispheres are held together by a centrifugal latch. The auto-rotation accomplishes two actions in concert, namely, dispersion of the submissiles from the release point and activation of the centrifugal latch which allows disengagement of the two hemispheres. At the same time the standoff legs assume their armed functional position while one of the hemispheres remains connected to the submissile by way of a lanyard. The submissile descends in its correct physical orientation and upon impact, an inertial fuze initiates an explosive train including a high explosive booster and the high explosive Octol charge. The detonation ruptures the fragmenting shell dispersing and propelling a multitude of small highly lethal anti-personnel fragments. Simultaneously, due to the shape of the Octol about the copper conical liner and the submissile orientation including the standoff provided by the legs, an armor piercing phenomenon results. Thus, the submissile is capable of both anti-personnel as well as anti-material destructive action.

It should be understood, of course, that the foregoing disclosure relates to only a preferred embodiment of the invention and that numerous modifications or alterations may be made therein without departing from the spirit and the scope of the invention as set forth in the appended claims.

I claim:

1. A dual purpose air deliverable submunition comprising:

a pair of hemispherical overlay shells;

means for releasably securing said hemispheres together;

means for spacially securing one of said hemispheres to a high explosive munition disposed in the plenum defined by said hemispheres and including therein;

a fragmentation outer shell having disposed therein, an inertial fuze and booster for impact detonating, a shaped high explosive charge, standoff means carried by said munition for providing a standoff spacing between said munition and a target upon impact therebetween.

2. The submunition according to claim 1 wherein said means for releasably securing is a centrifugal latch.

3. The submunition according to claim 2 wherein said hemispherical overlay shells are provided with a plurality of externally disposed flutes for inducing rotation of said submunition during its initial descent.

4. The submunition according to claim 3 wherein said means for spacially securing is a lanyard affixed to one of said hemispheres and said high explosive munition for providing vertical descent orientation thereof.

5. The submunition according to claim 4 wherein said standoff means includes a plurality of spaced apart spring biased legs disposed intermediate said hemispheres and said high explosive munition and biased to extend downwardly when said hemispheres separate.

6. The submunition according to claim 5 wherein said shaped charge is formed with a central conical aperture having its apex directed upwardly.

7. The submunition according to claim 6 further including a liner defining said aperture.

* * * * *